US009066608B2

(12) United States Patent
Park

(10) Patent No.: US 9,066,608 B2
(45) Date of Patent: Jun. 30, 2015

(54) NURSING CUSHION

(76) Inventor: Moon Hwan Park, Seoul (KR)

( * ) Notice: Subject to any disclaimer, the term of this patent is extended or adjusted under 35 U.S.C. 154(b) by 0 days.

(21) Appl. No.: 13/144,676

(22) PCT Filed: Jan. 12, 2010

(86) PCT No.: PCT/KR2010/000170

§ 371 (c)(1),
(2), (4) Date: Jul. 14, 2011

(87) PCT Pub. No.: WO2010/082746

PCT Pub. Date: Jul. 22, 2010

(65) Prior Publication Data

US 2011/0271455 A1 Nov. 10, 2011

(30) Foreign Application Priority Data

Jan. 14, 2009 (KR) ..... 10-2009-0003113

(51) Int. Cl.
*A47C 16/00* (2006.01)
*A47D 13/02* (2006.01)

(52) U.S. Cl.
CPC ..... *A47D 13/02* (2013.01)

(58) Field of Classification Search
USPC ..... 5/655, 632, 633, 101, 603
See application file for complete search history.

(56) References Cited

U.S. PATENT DOCUMENTS

| | | | | |
|---|---|---|---|---|
| 2,973,889 | A * | 3/1961 | Phillips | 294/140 |
| 4,825,487 | A * | 5/1989 | Eberl | 5/655 |
| 5,029,351 | A * | 7/1991 | Weber | 5/655 |
| 5,551,109 | A | 9/1996 | Tingley et al. | |
| 2005/0278854 | A1 | 12/2005 | Taricani, Jr. | |
| 2007/0108810 | A1 | 5/2007 | Nishimoto et al. | |
| 2007/0283502 | A1 * | 12/2007 | Tullous | 5/733 |
| 2008/0060135 | A1 * | 3/2008 | Wong | 5/655 |

FOREIGN PATENT DOCUMENTS

| | | |
|---|---|---|
| CN | 101039606 | 9/2007 |
| EP | 1745724 | 1/2007 |
| JP | 2005-312772 | 11/2005 |
| KR | 20-1992-0002790 | 5/1992 |

OTHER PUBLICATIONS

International Search Report for PCT/KR2010/000170 mailed Sep. 27, 2010.

* cited by examiner

*Primary Examiner* — Robert G Santos
*Assistant Examiner* — Richard G Davis
(74) *Attorney, Agent, or Firm* — Revolution IP, PLLC

(57) ABSTRACT

A nursing cushion having a head support portion, a buttock support portion, and a leg support portion, for supporting the head, buttocks, and legs of an infant during nursing. The head support portion is formed into a curved concave shape for supporting the rear part of the head of the infant. A neck-supporting curved portion protrudes from beneath the head support portion to support the rear part of the neck of the infant. The buttock support portion is formed into a curved concave shape beneath the neck-supporting curved portion to support the buttocks of the infant. A knee supporting curved portion protrudes from beneath the buttock support portion to support the rear part of the knee of the infant. The leg support portion is formed beneath the knee-supporting curved portion to support the leg of the infant. The buttock support portion has, at both upper edges thereof, gently formed recesses.

6 Claims, 6 Drawing Sheets

NURSING CUSHION

RELATED APPLICATIONS

This application is a 371 application of International Application No. PCT/KR2010/000170, filed Jan. 12, 2010, which in turn claims priority from Korean Patent Application No. 10-2009-0003113, filed Jan. 14, 2009, each of which is incorporated herein by reference in its entirety.

TECHNICAL FIELD

The present invention relates to a nursing cushion that enables baby or infant to be laid down in a stable posture, more specifically, a nursing cushion that has a curved shape corresponding to the body shape of the infant to enable the baby or infant to maintain a stable posture, thereby enabling the nurse to have the infant in her arms in a stable posture, thus ensuring the convenience of use and reducing a danger of safety accident.

BACKGROUND ART

In general, skeleton of the body of the new-born baby or infant is not complete, so that significant care is required when the carer has the baby in her arms or lays down the baby. In particular, in order to move while having the baby in her arms or nurse the baby, before doing so, the carer should wrap the baby with a quilt of a certain thickness and then have the quilt together with the baby in her arms, and thereafter may nurse the baby or move together with the baby, so that both the carer and baby experience discomfort.

In order to solve the above-mentioned problem, various types of seats have been proposed, wherein as exemplary one, there are mentioned a baby strap constructed by connecting a strap with a predetermined length allowing for fastening of the strap to a part of the body of the carer to a wrapper having such a wide area as to wrap the baby and made of substrate such as cloth, and car seat that can prevent the infant from deviating from his or her position by providing projected cushion material on both side walls of a flat plate member.

In the case of the baby strap, since the wrapper is made of cloth, the wrapper may not maintain its shape completely in the case that the carer has the infant in her arms for a long time, and as the infant is wrapped while his or her head and legs face toward abdomen of the carer, stability is not ensured and thus discomfort is caused and also too much load is exerted to the body of the baby.

In the case of the car seat, it can support the infant in a posture of the infant being laid down on the flat plate member or seated thereon, however, since the car seat is bulky, it is not easy to carry and also for nursing the infant, the carer should lift the infant from the car seat to have the infant in her arms, which results in a disadvantage that its use other than use for vehicle is extremely limited.

Besides, the baby carriage or rocking bed is also equipped with a seat, however, disadvantages still remain that the use of the seat is limited to pertinent product and for nursing the infant the carer should lift the infant to have the infant in her arms.

SUMMARY OF THE INVENTION

The present invention has been devised to solve the above-mentioned problems, its objects is to provide a nursing cushion that has a curved shape corresponding to the body shape of the infant to enable the baby or infant to maintain a stable posture, thereby enabling the nurse to have the infant in her arms in a stable posture, thus ensuring the convenience of use and reducing a danger of safety accident.

For achieving the object, the nursing cushion of the present invention comprises a head support portion, a buttock support portion and a leg support portion for supporting the head, buttocks and legs of an infant during nursing of the infant.

The head support portion is formed into a curved concave shape for supporting the rear part of the head of the infant, a neck-supporting curved portion is curvedly and protrudingly formed beneath the head support portion to support the rear part of the neck of the infant, the buttock support portion is formed into a curved concave shape beneath the neck-supporting curved portion to support the buttocks of the infant, a knee-supporting curved portion is curvedly and protrudingly formed beneath the buttock support portion to support the rear part of the knee of the infant, and the leg support portion is formed beneath the knee-supporting curved portion to support the legs of the infant, and concave portions are gently formed on edges of both sides of the upper part of the buttock support portion.

Features and advantages of the present invention will be more apparent from the following detailed description with reference to the attached drawings. Prior to this, terms or words used in the specification and claims should not be interpreted as normal and lexical meanings, but should be interpreted as meanings and concepts coinciding to technical concepts of the present invention based on the principle that inventors may properly define the concepts of the terms in order to explain their inventions in a best way.

The nursing cushion according to the present invention has curved concaves fitted to the body structure of the infant to enable the infant to maintain a comfort and stable posture during nursing.

That is to say, due to structural features of the head support portion and buttock support portion connected by the neck-supporting curved portion for supporting the neck of the infant and the buttock support portion and leg support portion connected by the knee-supporting curved portion for supporting the rear part of the knee of the infant, when the infant is laid down, the head, neck and back, buttocks and legs of the infant are evenly supported, so that the infant can maintain a comfort and stable posture.

Furthermore, the nursing cushion of the present invention is slim and can be utilized for various applications, and for example, since the carer can nurse the infant while having the cushion in her arms with the infant laid down therein, both of the carer and infant can maintain mental stability and stable posture, whereby a useful effect is expected that a danger of safety accident such as the infant falling can be greatly reduced.

Besides, since the nursing cushion of the present invention can be applied to the rocking bed or car seat and a seat of the baby carriage, or detachably applied thereto, a single product can be utilized for various applications, and thus convenience of use can be ensured, whereby the level of the satisfaction of the consumers using it can be enhanced.

DETAILED DESCRIPTION OF EXEMPLARY EMBODIMENTS

Figure 1:
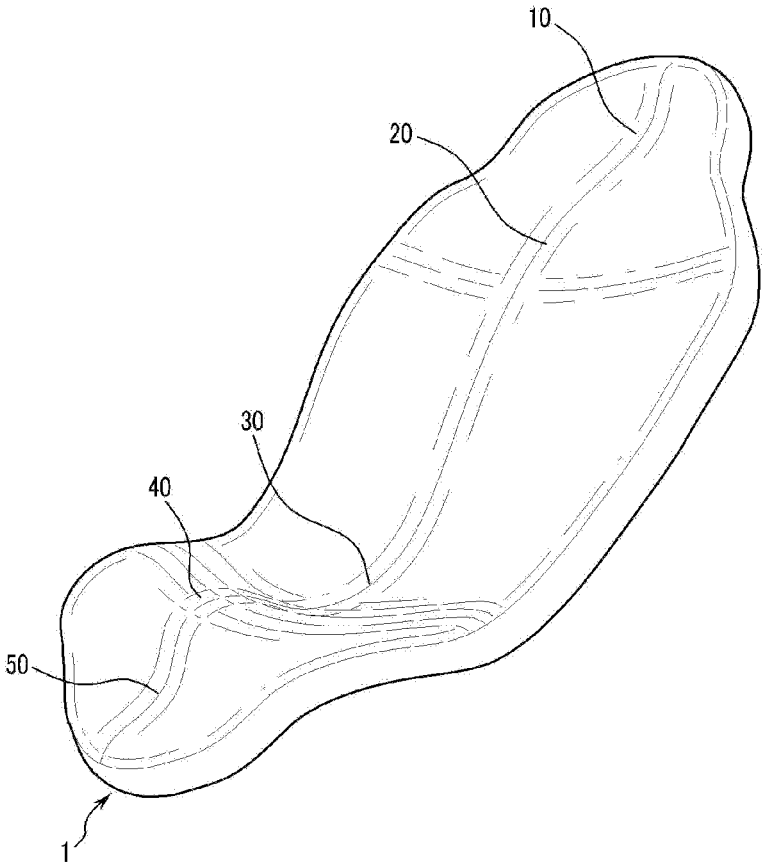
FIG. 1 is a perspective view showing the nursing cushion according to the present invention.

Hereinafter, the nursing cushion according to the present invention will be described with reference to the attached drawings.

First, in the drawings, it should be noted that the same components or parts are designated by the same reference numeral, if possible. The detailed description of related known functions or constructions will be omitted so as not to obscure the gist of the present invention.

Figure 2:
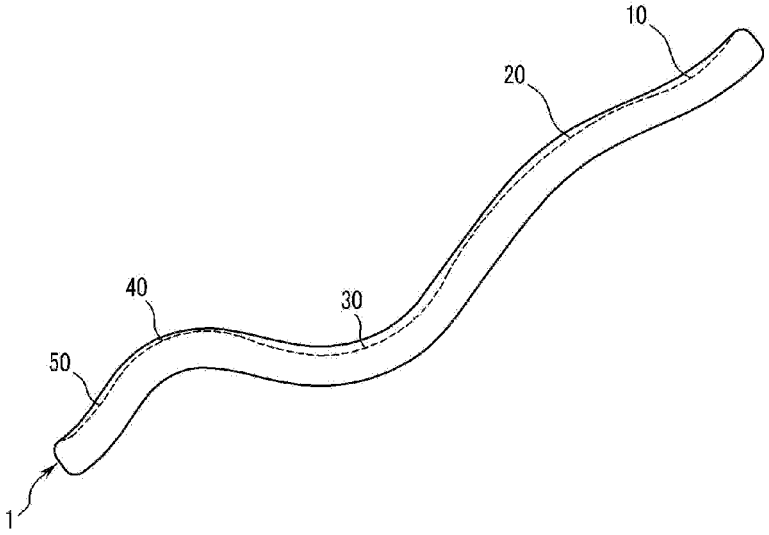
FIG. 2 is a side view showing the nursing cushion according to the present invention.

FIG. 1 is a perspective view showing the nursing cushion according to the present invention, and FIG. 2 is a side view showing the nursing cushion according to the present invention.

Figure 3:
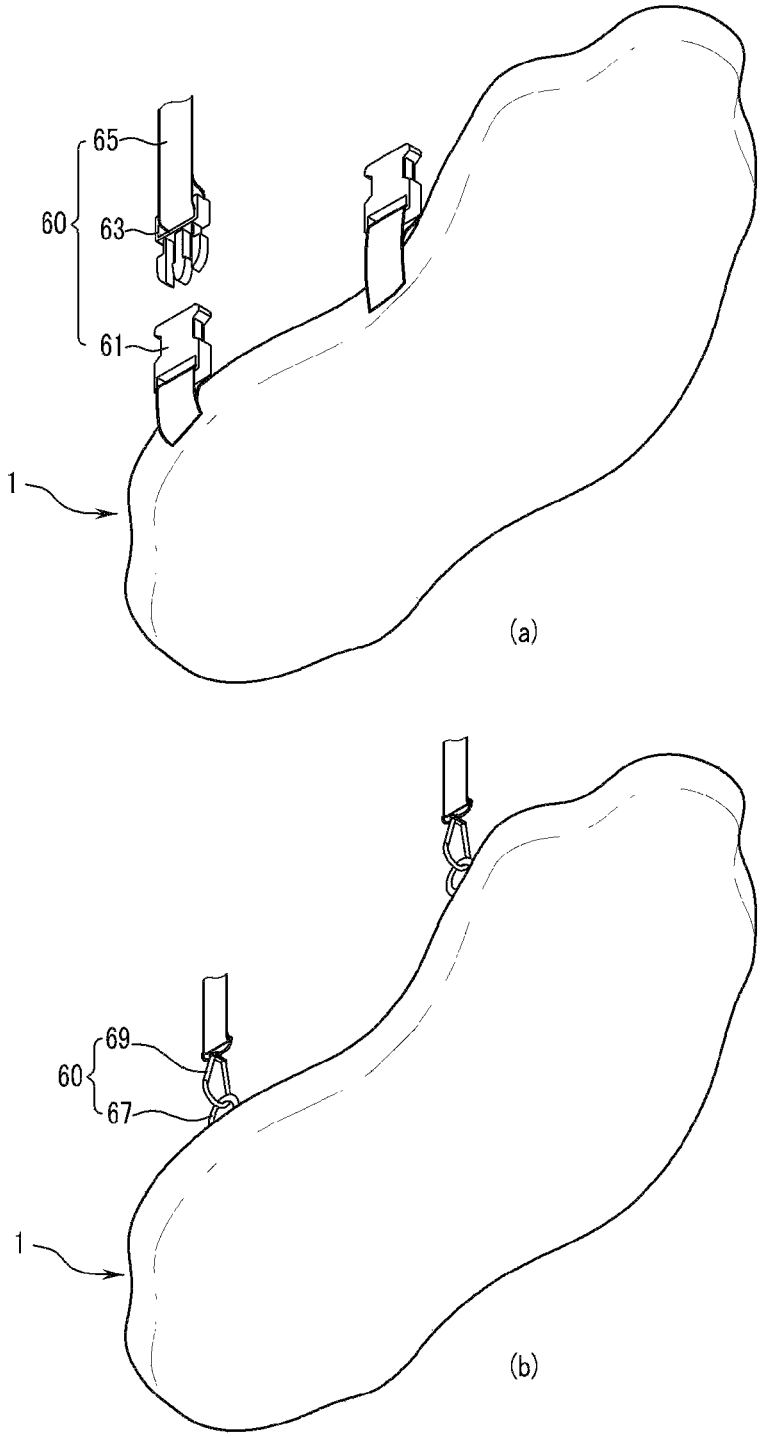
FIG. 3 is a rear view showing the nursing cushion according to the present invention.
Figure 4:
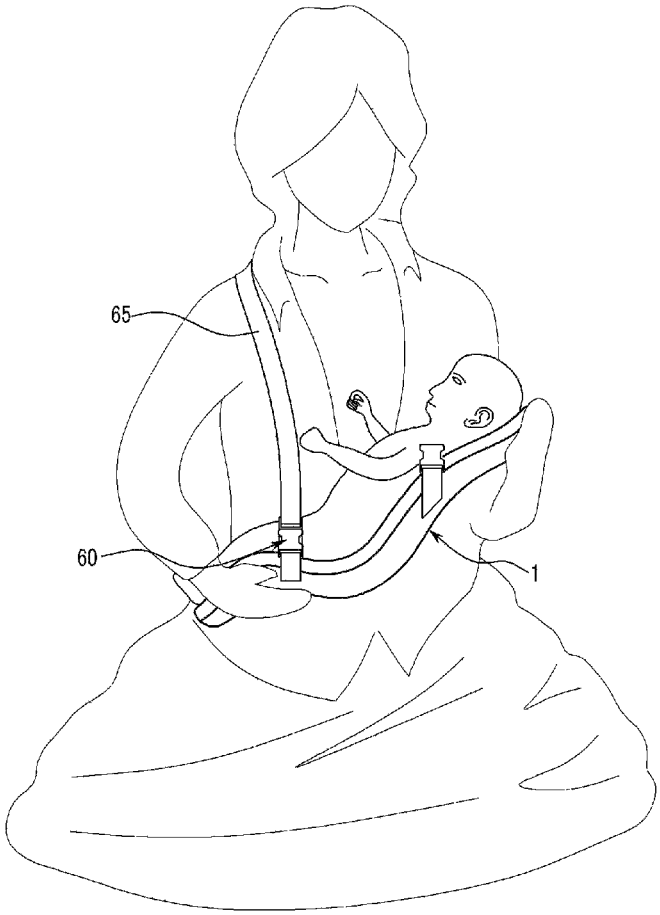
FIG. 4 is a mimetic diagram showing an example of using the nursing cushion according to the present invention.

FIG. 3 is a rear view showing the nursing cushion according to the present invention, and FIG. 4 is a mimetic diagram showing an example of using the nursing cushion according to the present invention.

Figure 5:
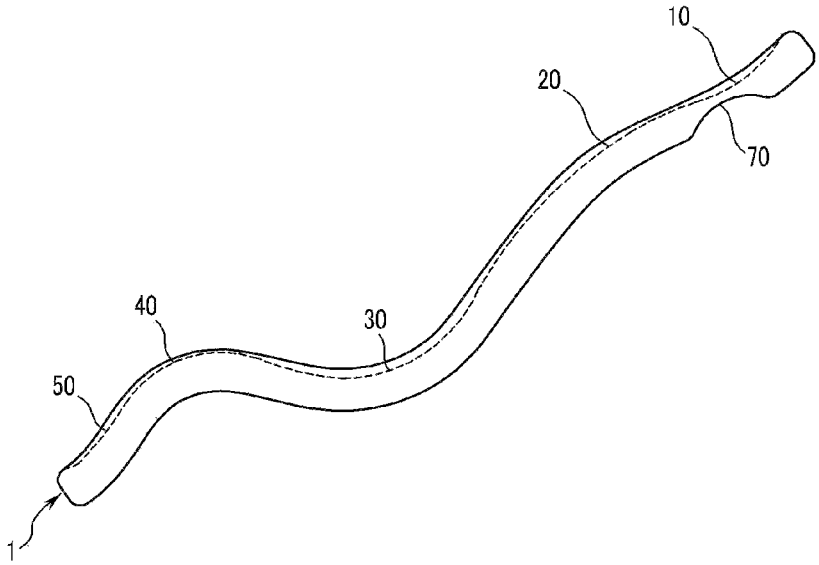
FIG. 5 is a side view showing another example of the present invention.
Figure 6:
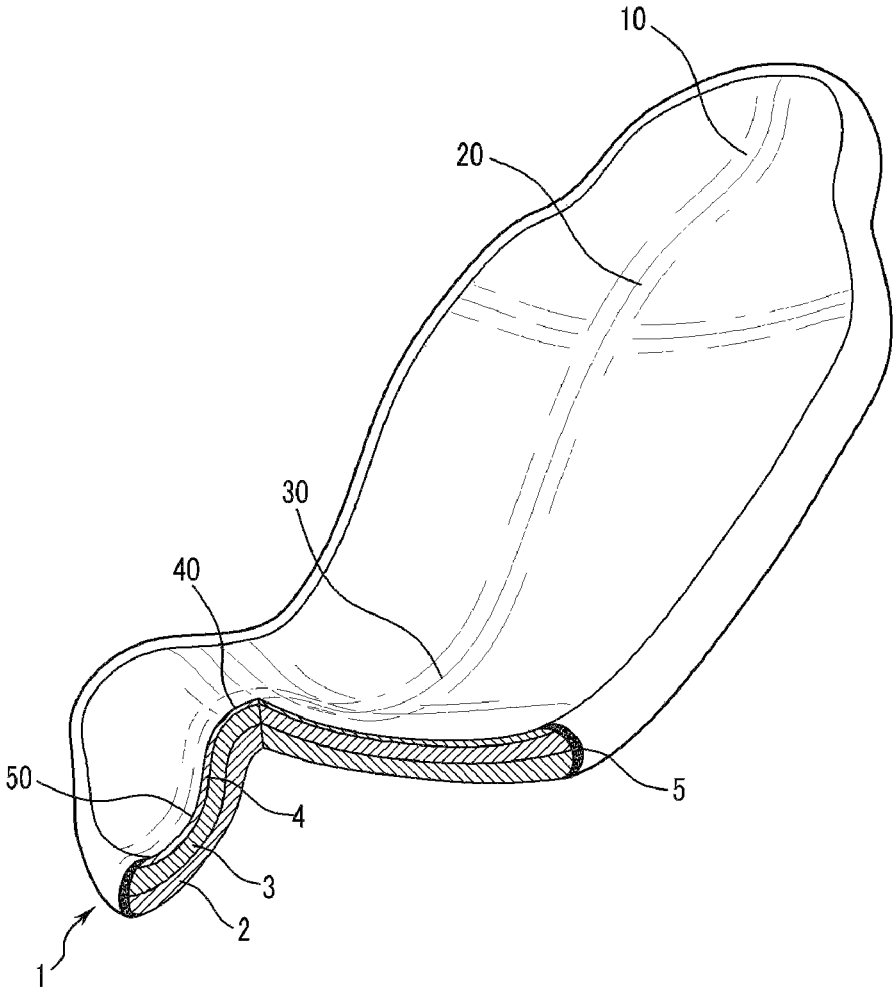
FIG. 6 is a cut-out view for explaining internal construction of the nursing cushion according to the present invention.

Finally, FIG. 5 is a side view showing another example of the present invention, and FIG. 6 is a cut-out view for explaining internal construction of the nursing cushion according to the present invention.

First, the nursing cushion (1) according to the present invention is illustrated for nursing in the drawings of the present invention, however, it should be noted that the present invention is not limited to the nursing and the cushion may be applied to infant articles to which seats are usually applied. For example, the cushion may be applied as infant seats for vehicle, seats for rocking beds, or seats for baby carriage, and may be provided to each article while being integrated therewith or detachably attached to the article.

Hereinbelow, preferred examples of the nursing cushion (1) of the present invention will be described.

The nursing cushion (1) of the present invention is produced by injection molding of synthetic resin material, and comprises a head support portion (10), a buttock support portion (30) and a leg support portion (50) for supporting the head, buttocks and legs of an infant during nursing.

Here, the head support portion (10) is formed into a curved concave shape for supporting the rear part of the head of the infant, a neck-supporting curved portion (20) is curvedly and protrudingly formed beneath the head support portion (10) to support the rear part of the neck of the infant, the buttock support portion (30) is formed into a curved concave shape beneath the neck-supporting curved portion (20) to support the buttocks of the infant, a knee-supporting curved portion (40) is curvedly and protrudingly formed beneath the buttock support portion (30) to support the rear part of the knee of the infant, and the leg support portion (50) is formed beneath the knee-supporting curved portion (40) to support the legs of the infant.

That is to say, the head support portion (10) and buttock support portion (30) are connected to each other by the gently protruded neck-supporting curved portion (20), wherein the neck-supporting curved portion (20) is a portion for supporting the rear part of the neck of the infant.

Furthermore, the buttock support portion (30) and leg support portion (50) are also connected to each other by the gently protruded knee-supporting curved portion (40), wherein the knee-supporting curved portion (40) is a portion for supporting the rear part of the knee of the infant.

Meanwhile, among the head support portion (10), the buttock support portion (30) and leg support portion (50) of the present invention, in the whole the buttock support portion (30) is formed so as to have the largest sized groove, the leg support portion (50) has the next largest sized groove, and the head support portion (10) has the smallest sized groove. Furthermore, the knee-supporting curved portion (40) is protruded relative to the neck-supporting curved portion (20), whereby the nursing cushion wholly corresponds to curves of the body of the infant, thereby evenly supporting the body.

Furthermore, for the nursing cushion (1) of the present invention, the head support portion (10), the neck-supporting curved portion (20), the buttock support portion (30), the knee-supporting curved portion (40) and the leg support portion (50) are formed in a single piece by injection, and a rim portion (5) made of relatively soft material is provided along edge of the nursing cushion (1). For example, in the case that the head support portion (10), the neck-supporting curved portion (20), the buttock support portion (30), the knee-supporting curved portion (40) and the leg support portion (50) are formed of plastic material in a single piece, the rim portion (5) provided as a finishing material to the edge of the formed body is formed of relatively soft material (silicone, urethane material etc.), and in this regard, for a method for providing the rim portion (5), attaching of the portion as a separate member or insert injection may be utilized.

FIG. 3 is a rear view showing the nursing cushion according to the present invention, and the present invention may further comprise fasteners (60) for enabling the carer to have the nursing cushion (1) in her arms.

In this regard, by means of the fasteners (60), an elongate strap (65) is connected to one side of at least one of the head support portion (10), the buttock support portion (30) and the leg support portion (50). Such fasteners (60) are provided as a ring member to the support portion and the strap is tied to the ring member, or the fasteners are provided in the form of a hook (69) arranged at one end of the strap (65) and a ring member (67) arranged on the support portion, as show in FIG. 3(*b*). In addition, the fasteners may be provided in the form of a male coupler (63) arranged on one end of the strap (65) and a female coupler (61) arranged on one side of the support portion, which couplers are resiliently fitted to each other, as shown in FIG. 3(*a*).

Such fasteners (60) may be embodied by means of the known various arts, and thus detailed description thereof will be omitted.

With the nursing cushion (1) with the strap (65) connected thereto by the fasteners (60) of the above-mentioned construction, the carer has the whole nursing cushion (1) in her arms with the infant laid down in the cushion, and thereafter makes the cushion supported on a part of the body by use of the strap (65), and may then nurse the infant.

Meanwhile, the strap (65) may be provided in such a form that it can be supported on the body of the carer, or may be applied by modification into such a structure that it can be attached to the rocking bed, car seat or baby carriage, not illustrated in the drawings.

FIG. 5 is a side view showing another example of the present invention, and as shown in this figure, in the nursing cushion (1) according to this example, a groove portion (70) may be formed on the rear part of at least one of the head support portion and neck-supporting curved portion (20).

The groove portion (70) is a kind of groove formed on a path in which the arm of the carer is positioned such that the carer can have the nursing cushion (1) in her arms for nursing with a stability in view of human engineering.

FIG. 6 is a cut-out view showing internal construction of the nursing cushion (1) according to the present invention. As shown in this figure, the nursing cushion (1) of the present invention comprises a main body plate (2) with the head support portion (10), neck-supporting curved portion (20), buttock support portion (30), knee-supporting curved portion (40) and leg support portion (50) formed on one side, and a buffering pad (3) attached on a surface of the main body plate (2), namely, on the side of a contact surface contacting with the body of the infant along each curved portion, which pad is formed of at least one of synthetic resin material, urethane material, rubber material and silicone material or combination of at least one thereof. Detachably attached on a surface of the buffering pad (3) is a fabric cover (4) made of natural fabric such as cotton etc.

Here, the main body plate (2) and buffering pad (3) are joined to each other, and the fabric cover (4) is constructed so as to wrap the main body plate (2) together with the buffering pad (3) by use of string, hook and loop faster (Velcro) tape or fastener snap.

Figure 7:
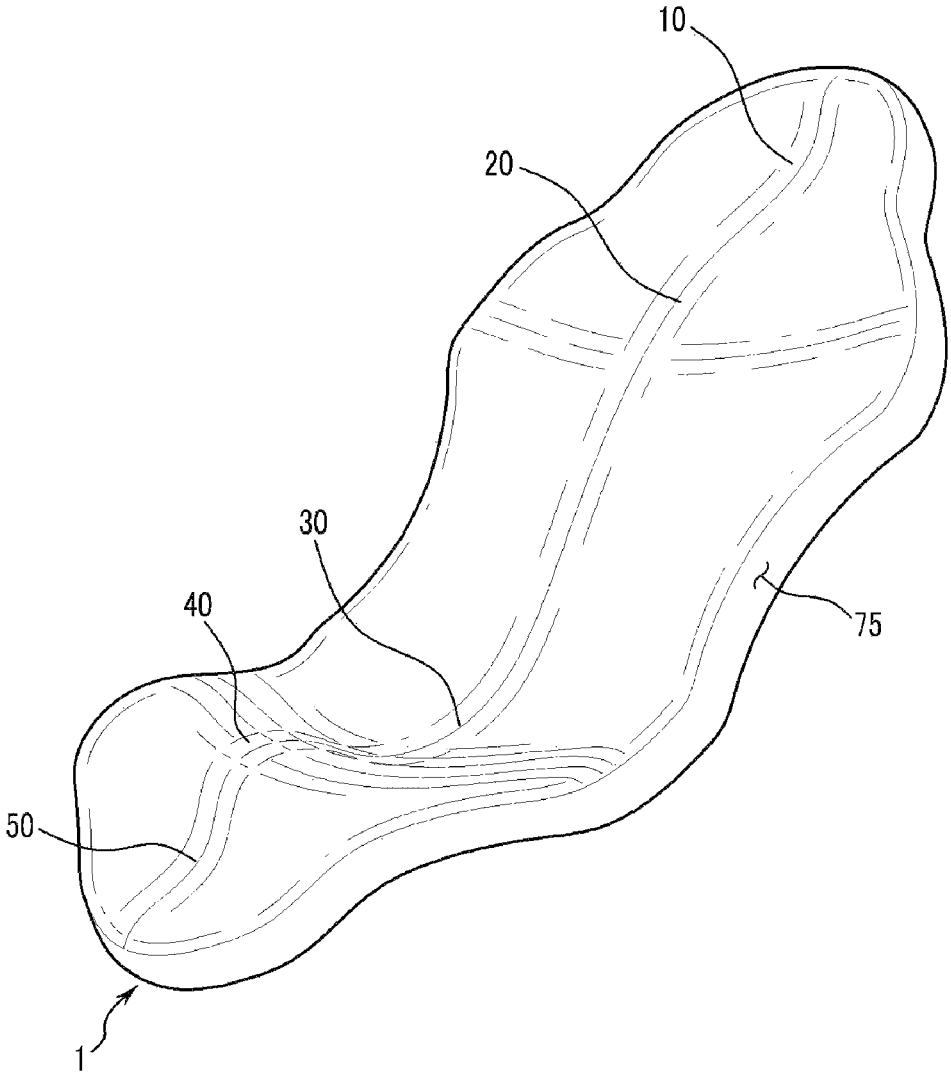
FIGS. 7 and 8 are perspective views showing yet another examples of the nursing cushion according to the present invention.

FIG. 7 is a perspective view showing an example of the nursing cushion according to the present invention. As shown in this figure, in the nursing cushion (1) of this example, concave portions (75) are additionally formed on edges of both sides of the upper part of the buttock support portion (30) with such a gentle curvature as to receive a part of the breast of the carer such that the carer can become closer to the infant laid down in the cushion when having the nursing cushion in her arms.

As described above, by means of the concave portions (75) concavely formed on the edges of both sides of the upper part of the buttock support portion (30), the breast of the carer can be in close contact with the cushion in a stable manner.

Figure 8:
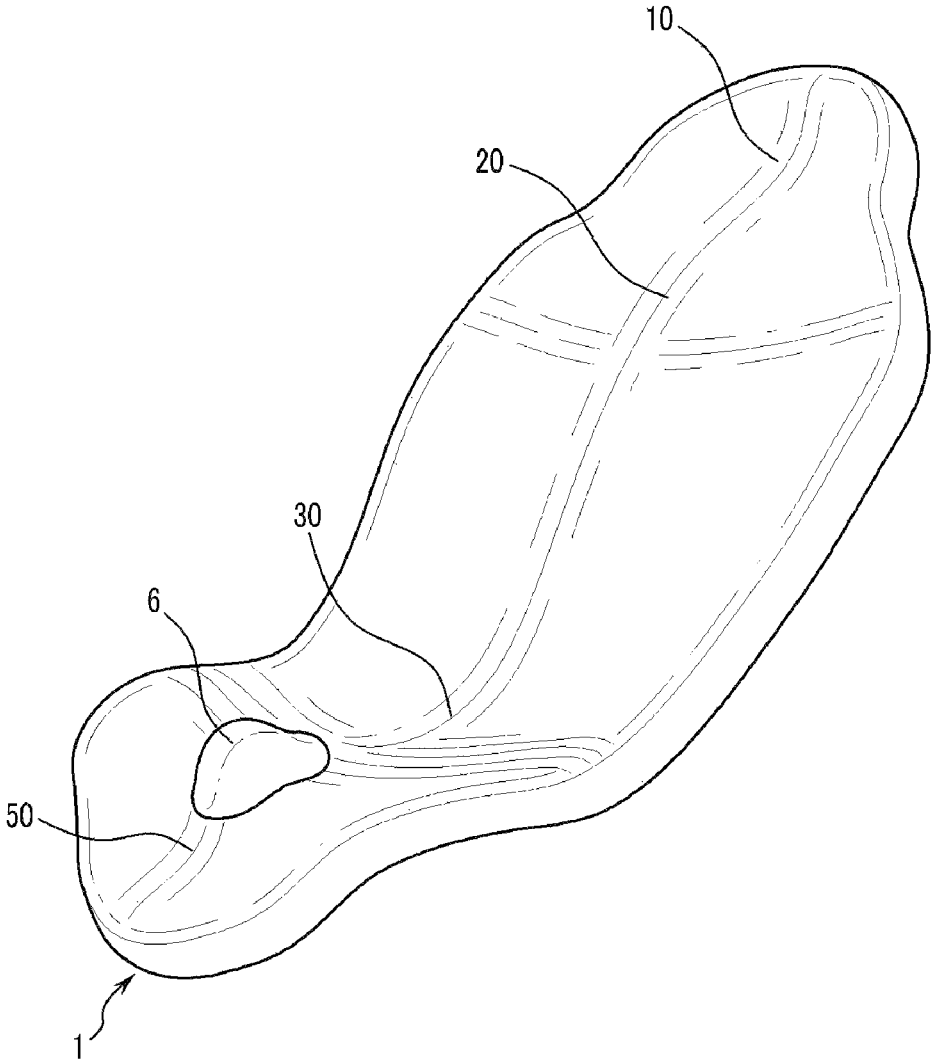

FIG. 8 is a view showing yet another example of the nursing cushion according to the present invention. When the cushion is applied to the car seat or baby carriage, the infant are seated in an oblique posture, and in this regard, in order to prevent the infant from moving downward, namely, toward the leg support portion (50) due to his/her own weight, a crotch support portion (6) is additionally provided.

That is to say, the crotch support portion (6) is curvedly and protrudingly formed on at least one of the buttock support portion (30), leg support portion (50) and knee-supporting curved portion (40) connecting them, and disposed between the crotches of the infant to prevent the infant from moving toward the leg support portion (50). Such a crotch support portion (6) may be made of soft material, for example, urethane material, silicone material, soft synthetic resin material, rubber material or fabric as the case of the rim portion (5), and may integrally injection molded to the main body plate (2) constituting the nursing cushion of the present invention or attached thereto as a separate member.

Meanwhile, the present invention is not limited to the examples as described above, and it goes without saying that the persons having ordinary skills in the art may carry out the present invention by various modifications and alterations thereof without departing from concept and scope of the present invention, and such modifications or alterations also fall within the scope of the claims of the present invention.

What is claimed:

1. A nursing cushion comprising a head support portion, a buttock support portion and a leg support portion for supporting the head, buttocks and legs of an infant during nursing of the infant, wherein the head support portion is formed into a curved three-dimensionally concave shape for supporting the rear part of the head of the infant, a neck-supporting curved portion is curvedly and protrudingly formed beneath the head support portion to support the rear part of the neck of the infant, the buttock support portion is formed into a curved three-dimensionally concave shape and defines a first circular arc with a back portion, the buttock support portion beneath the neck-supporting curved portion and to support the buttocks of the infant, a knee-supporting curved portion is curvedly and protrudingly formed beneath the buttock support portion in a second circular arc with the buttock support portion, the knee-supporting curved portion to support the rear part of the knee of the infant, and the leg support portion is formed beneath the knee-supporting curved portion to support the legs of the infant, and wherein the head support portion, buttock support portion, and leg support portion are monolithic.

2. The nursing cushion according to claim 1, wherein a groove portion is formed on the rear part of at least one of the head support portion and buttock support portion.

3. The nursing cushion according to claim 1, wherein a main body plate is formed with the head support portion, neck-supporting curved portion, buttock support portion, knee-supporting curved portion and leg support portion integrally formed, and a buffering pad is provided on the main body plate, and a fabric cover is detachably provided on the fabric cover.

4. The nursing cushion according to claim 3, wherein a rim portion is provided along edges of the head support portion, the neck-supporting curved portion, buttock support portion, knee-supporting curved portion and leg support portion, and the rim portion is made of silicone or urethane.

5. The nursing cushion according to claim 2, wherein a main body plate is formed with the head support portion, neck-supporting curved portion, buttock support portion, knee-supporting curved portion and leg support portion integrally formed, and a buffering pad is provided on the main body plate, and a fabric cover is detachably provided on the fabric cover.

6. The nursing cushion according to claim 5, wherein a rim portion is provided along edges of the head support portion, the neck-supporting curved portion, buttock support portion, knee-supporting curved portion and leg support portion, and the rim portion is made of silicone or urethane.

* * * * *